US006142546A

United States Patent [19]

Hansort

[11] Patent Number: 6,142,546

[45] Date of Patent: Nov. 7, 2000

[54] RING CLUTCH HOISTING ASSEMBLY

[75] Inventor: Marinus G. A. Hansort, Goirle, Netherlands

[73] Assignee: Novitec International B.V., Netherlands

[21] Appl. No.: 09/173,321

[22] Filed: Oct. 15, 1998

[51] Int. Cl.[7] ..... B66C 1/66

[52] U.S. Cl. ..... 294/89; 294/82.35

[58] Field of Search ..... 294/82.24, 82.27, 294/82.31–82.35, 89; 24/598.7, 599.3, 601.6; 52/122.1, 124.2, 125.2, 125.4

[56] References Cited

U.S. PATENT DOCUMENTS

| | | | |
|---|---|---|---|
| Re. 033,881 | 4/1992 | Courtois et al. | 294/89 |
| 3,883,170 | 5/1975 | Fricker et al. | 294/89 X |
| 3,965,541 | 6/1976 | Davison | 24/122.6 |
| 4,398,762 | 8/1983 | Haeussler et al. | 294/89 |
| 4,437,642 | 3/1984 | Holt | 249/175 |
| 4,627,198 | 12/1986 | Francies | 294/89 X |
| 4,634,164 | 1/1987 | Fricker | 294/89 |
| 4,671,554 | 6/1987 | Lancelot | 294/89 |
| 5,226,265 | 7/1993 | Kelly et al. | 294/89 X |
| 5,244,243 | 9/1993 | Grayson et al. | 294/89 |

FOREIGN PATENT DOCUMENTS

| | | | |
|---|---|---|---|
| 2382398 | 9/1978 | France . | |
| 2240171 | 3/1974 | Germany | 294/89 |
| 3415884 | 10/1985 | Germany . | |
| 239092 | 9/1990 | Japan | 294/82.35 |
| 23189 | 1/1991 | Japan | 294/82.35 |

*Primary Examiner*—Johnny D. Cherry
*Attorney, Agent, or Firm*—Felsman, Bradley, Vaden, Gunter & Dillon, LLP; Frank S. Vaden; Constance Gall Rhebergen

[57] ABSTRACT

A hoisting assembly is comprised of a hoisting element and a coupling element. The coupling element comprises a housing and a closure element. An anchor-accommodating space is arranged in the housing which can in a close-fitting manner accommodate an anchor which is attached to an object to be lifted. With such a hoisting assembly the hoisting force is transmitted to the free end of the anchor without the hoisting assembly damaging the object to be lifted.

5 Claims, 3 Drawing Sheets

RING CLUTCH HOISTING ASSEMBLY

TECHNICAL FIELD OF THE INVENTION

The present invention relates to a hoisting assembly. In the construction engineering world, by way of example, prefabricated construction elements, such as wall and floor parts, are widely used. In order to be able to move the construction elements, anchors are arranged in the construction elements. One end of the anchors is left free, so that a hoisting assembly can be coupled to an anchor. In practice, it is desirable for it to be possible to couple the hoisting assembly to the anchor in a simple manner and to uncouple it easily after the construction element has been put in place.

PRIOR ART

DE-3,415,884 has disclosed a hoisting assembly which can be used for moving prefabricated concrete construction elements, such as floors, walls, etc. One or more anchors are arranged in each construction element. An anchor is substantially elongate and has a substantially rectangular cross-section in a plane perpendicular to the longitudinal axis of the anchor. In order for it to be anchored firmly in the concrete construction element, projections are arranged at an end which is situated in the construction element. The other end is left free and provided with a hole.

The hoisting assembly which is known from DE-3,415,884 comprises a link and a coupling element. The coupling element comprises a circular housing, an anchor-accommodating space of which can be placed over the free end of the anchor. The anchor is wider than the housing, so that on two sides the anchor projects outside the housing of the coupling element. In order to lock the anchor in the coupling element, the coupling element is provided with a closure element which can be rotated into a locking position, so that the closure element extends through the hole which is arranged in the anchor. During hoisting, the anchor "hangs" from the coupling element with the aid of the closure element.

The coupling element of the known hoisting assembly is substantially in the form of a round disc, the link being inserted through an opening, which is parallel to the axis, in the housing, and a lever which is attached to the closure element projecting radially outwards from the housing. When the closure element is moved into the locking position, a stop on the housing defines the maximum extent to which the closure element can be rotated.

If the hoisting assembly is used in a situation where the direction of the hoisting force is substantially parallel to the axis of the housing, the link and/or the coupling element are supported against the construction element. This causes damage to the construction element. In order to prevent this damage, in practice a special hoisting anchor which is suitable for such a situation is employed. In this case, the anchor is provided with one or more "wings", one end face of each wing coinciding with the outer face of the construction element. If the direction of the hoisting force is parallel to the axis of the housing, the link and/or the coupling element bear against the wing, so that damage to the construction element is prevented. However, this implies the need for two types of anchors, and it is necessary to determine beforehand which type of anchor should be cast in the construction element. This is laborious and time-consuming.

In the case of the hoisting assembly which is known from DE-3,415,884, the movement of the closure element towards the release position is limited by the angular displacement of the link with respect to the coupling element. If, at the end of a hoisting action, the link is bearing against the lever, the link must first be rotated away from the lever through at least 90° before the closure element can be rotated into the release position. Owing to the weight of the link, this causes a moment to be exerted by the housing on the free end of the anchor, with the result that it is difficult to remove the anchor from the anchor-accommodating space in the radial direction.

OBJECT OF THE INVENTION

One object of the present invention is to provide a hoisting assembly which, irrespective of the direction of the hoisting force, transmits the hoisting force to the free end of the anchor without damaging the construction element.

Another object of the present invention is to provide a hoisting assembly in which the closure element can be moved into the release position remotely without the need to rotate the link with respect to the coupling element before the anchor can be released.

Yet another object of the present invention is to provide a hoisting assembly in which the hoisting force can be transmitted to the anchor exclusively via the closure element.

SUMMARY OF THE INVENTION

In one aspect of the hoisting assembly according to the invention, the hoisting assembly comprises a hoisting element and a coupling element for coupling the hoisting assembly to an anchor element which is attached to an object to be lifted, the coupling element comprising a housing, an anchor-accommodating space and an insertion opening, which extends through the housing, being arranged in the housing, the anchor-accommodating space being suitable for accommodating a free end of the anchor element, and the hoisting element extending through the insertion opening, the coupling element furthermore comprising a closure element which is arranged movably in the housing, which closure element can be moved between a locking position, in which the closure element extends through the anchor-accommodating space, so that an anchor element accommodated in the anchor-accommodating space can be held in place, and a release position, in which the closure element is withdrawn from the anchor-accommodating space, so that an anchor element accommodated in the anchor-accommodating space can be released, an actuating member, by means of which the closure element can be actuated so as to move between the locking position and the release position, furthermore being arranged on the closure element, the anchor-accommodating space being delimited by wall sections which are integral with the housing, in such a manner that the anchor can be accommodated in the anchor-accommodating space in a close-fitting manner.

In another aspect of a hoisting assembly according to the invention, the hoisting assembly comprises a hoisting element and a coupling element for coupling the hoisting assembly to an anchor element which is attached to an object to be lifted, the coupling element comprising a housing, an anchor-accommodating space and an insertion opening, which extends through the housing, being arranged in the housing, the anchor-accommodating space being suitable for accommodating a free end of the anchor element, and the hoisting element extending through the insertion opening, the coupling element furthermore comprising a closure element which is arranged movably in the housing, which closure element can be moved between a locking position, in which the closure element extends through the anchor-accommodating space, so that an anchor element accommodated in the anchor-accommodating space can be held in place, and a release position, in which the closure element is withdrawn from the anchor-accommodating space, so that an anchor element accommodated in the anchor-accommodating space can be released, an actuating member, by means of which the closure element can be actuated so as to move between the locking position and the release position, furthermore being arranged on the closure element, the closure element comprising a hoisting eyelet and a hook part, the hoisting eyelet being coaxial with the said insertion opening in the housing and the hook part, in the locking position, extending through the anchor-accommodating space.

In yet another aspect of a hoisting assembly according to the invention, the hoisting assembly comprises a hoisting element and a coupling element for coupling the hoisting assembly to an anchor element which is attached to an object to be lifted, the coupling element comprising a housing, an anchor-accommodating space and an insertion opening, which extends through the housing, being arranged in the housing, the anchor-accommodating space being suitable for accommodating a free end of the anchor element, and the hoisting element extending through the insertion opening, the coupling element furthermore comprising a closure element which is arranged movably in the housing, which closure element can be moved between a locking position, in which the closure element extends through the anchor-accommodating space, so that an anchor element accommodated in the anchor-accommodating space can be held in place, and a release position, in which the closure element is withdrawn from the anchor-accommodating space, so that an anchor element accommodated in the anchor-accommodating space can be released, an actuating member, by means of which the closure element can be actuated so as to move between the locking position and the release position, furthermore being arranged on the closure element, a passage opening being arranged in the hoisting element for the actuating member, so that the closure element can move between the locking position and the release position irrespective of the position of the hoisting element.

These and other objects, characteristics and aspects of the present invention will emerge more clearly from the following description of a preferred embodiment of a hoisting assembly according to the invention.

DESCRIPTION OF THE DRAWINGS

A preferred embodiment of a hoisting assembly according to the invention will be explained in more detail with reference to the drawing, in which:

FIG. 1 shows a preferred embodiment of a hoisting assembly according to the invention. The hoisting assembly comprises a hoisting element, referred to in the following text as link 1, and a coupling element 2. The hoisting assembly can be coupled, by means of the coupling element 2, to a construction element 3, for example a concrete wall part. For this purpose, the construction element 3 is provided with a hoisting anchor 4. One end of the hoisting anchor is left free and emerges into a cavity 5 arranged in the construction element 3. The protruding end of the hoisting anchor 4 is provided with a coupling opening 12.

The coupling element 2 is composed of a housing 6 and a closure element 7. The housing 6 is substantially in the form of a round disc with an axial front wall, an axial rear wall and a circumferential wall. An axial insertion opening 19 (cf. FIG. 3), through which the link 1 extends, is arranged in the centre of the housing. A space in which the closure element 7 can be accommodated is left open inside the housing 6. The closure element 7 bears at least partially against part of the inner side of the circumferential wall of the housing 6. Furthermore, an opening which provides access to the space for the closure element 7 is provided on the circumference of the housing 6, so that the closure element 7 can be positioned in the space in the housing 6 in a simple manner.

Figure 1:
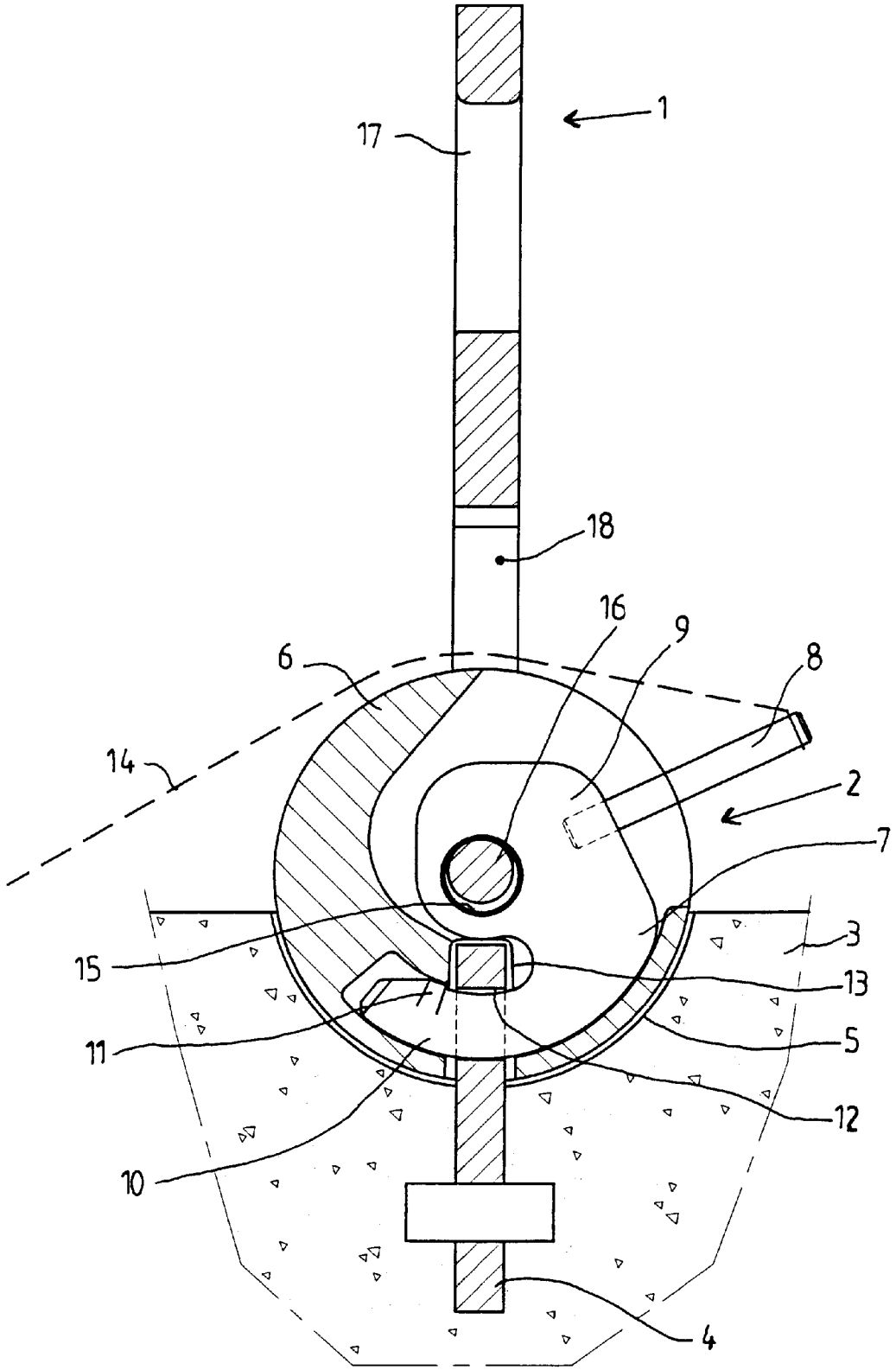
FIG. 1 shows a view, in section, of a hoisting assembly according to the invention.

The closure element 7 is substantially in the form of a hook with a body 9, in which a hoisting eyelet 15 is formed, and a hook part 10. The largest radial dimension of the closure element 7 from the centre of the hoisting eyelet is smaller than the radial dimension of the housing 6. The closure element 7 is partly of a circular form and can rotate by sliding along the inner side of the circumferential wall of the housing 6 in the interior of the housing 6. The insertion opening 19 in the housing 6 and the hoisting eyelet 15 of the body 9 are coaxial, so that the link 1 also extends through the hoisting eyelet 15 of the body 9. In the preferred embodiment, the link 1 comprises a substantially U-shaped bracket 16 which is fixed, by means of welding, to an engagement element 17. In the installed position, part of the U-shaped bracket 16 forms a rotation axle for the closure element 7 and the housing 6.

In order to be able to rotate the closure element 7, a lever 8, which extends outside the housing 6, is arranged on the closure element 7. A traction member 14 is attached to the free end of the lever 8. This traction member 14 may be a cable, a rope or the like. By means of the traction member 14, the closure element 7 can be actuated remotely so as to rotate from a locking position into a release position.

Furthermore, an anchor-accommodating space 13, which extends radially inwards from the circumferential surface, is arranged in the housing 6. The free end of the hoisting anchor 4 can be accommodated in this anchor-accommodating space 13 in a close-fitting manner.

In order to couple the hoisting assembly to the construction element 3, the closure element 7 is firstly rotated, with the aid of the lever 8, into a release position in which the anchor-accommodating space is completely clear. The anchor-accommodating space 13 in the coupling element 2 is then placed over the free end of the hoisting anchor 4, after which the closure element 7 is rotated, with the aid of the lever 8, into a locking position in which the hook part 10 is inserted through the coupling opening 12 in the hoisting anchor 4. The hoisting assembly is now coupled to the construction element 3. A hoisting device (not shown) can then be brought into engagement with the link 1, so that a hoisting force can be exerted.

In the preferred embodiment of the hoisting assembly according to the invention which is illustrated in FIG. 1, the hoisting force is transmitted to the hoisting anchor via the closure element 7 without the intervention of the housing 6. The hoisting force causes a frictional coupling between the closure element 7 and the head of the anchor 4. This frictional coupling prevents the closure element 7 from being able to rotate with respect to the housing 6 during hoisting; such rotation would cause the hoisting assembly to become uncoupled from the construction element 3. During hoisting, the housing 6 and the closure element 7 maintain their orientation with respect to the construction element 3 and the anchor 4.

As an additional protection against the hoisting assembly and the construction element 3 becoming uncoupled inadvertently, a projecting edge 11 is arranged on the hook part 10. When the coupling element 2 is coupled to a construction element 3, rotation of the closure element 7 is only possible when no radial force is being exerted on the closure element 7.

Figure 2:
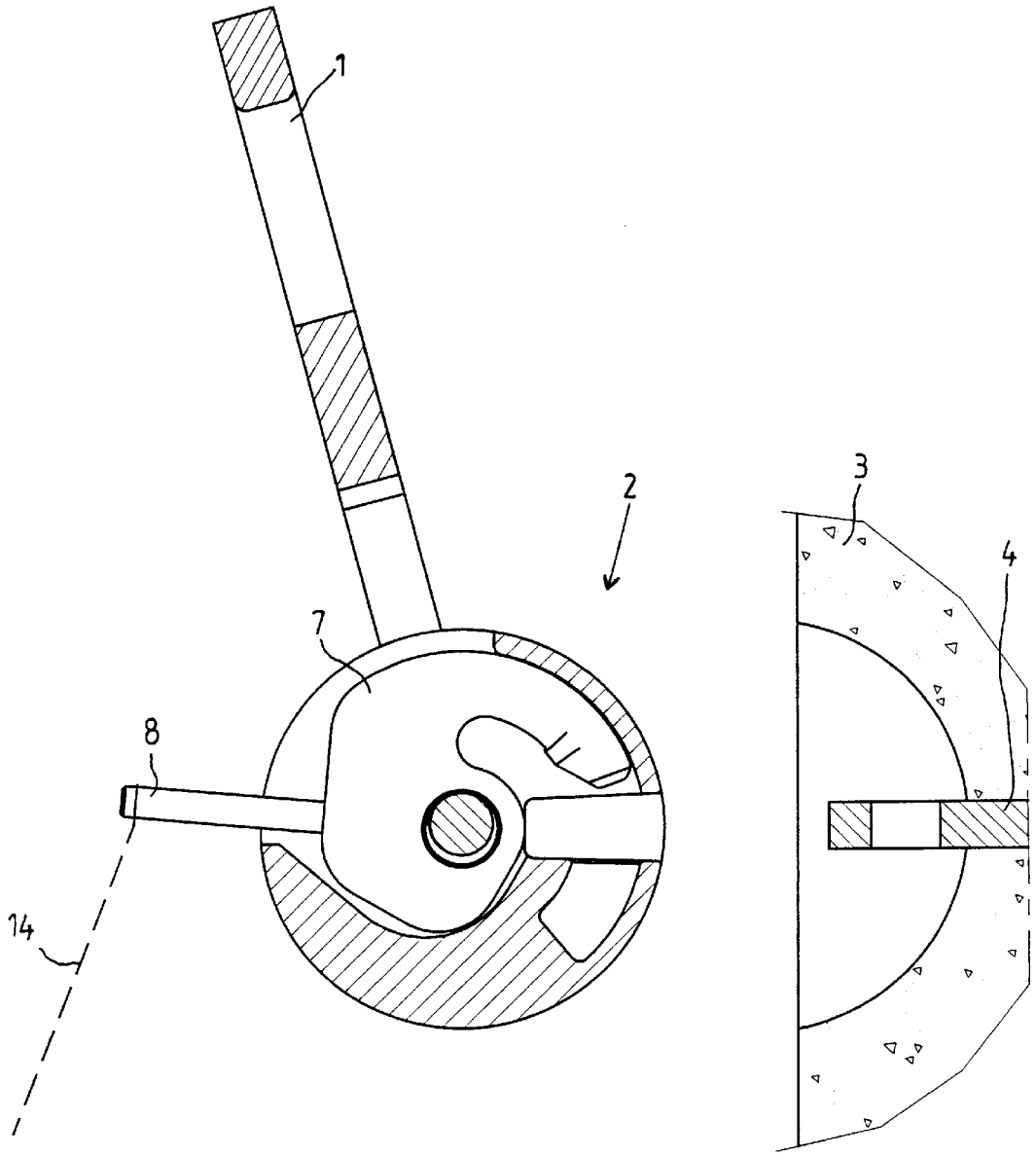
FIG. 2 shows a view, in section, of the hoisting assembly according to the invention at the moment of uncoupling.

The construction element 3 can now be lifted and moved, the construction element 3 being tilted, for example, from a horizontal to a vertical position. FIG. 2 shows the construction element 3 in a vertical position. During hoisting, the link 1 is rotated from the position illustrated in FIG. 1 with respect to the construction element 3 and the coupling element 2 which is coupled thereto, towards the lever 8. After the construction element 3 has been fitted in the correct position, the hoisting assembly can be uncoupled and removed from the construction element 3. To do this, the closure element 7 is rotated into the release position with the aid of the lever 8. The link 1 is designed with a passage opening 18 for the lever 8, so that the lever 8, which projects out of the housing 6, with the closure element 7 coupled thereto can rotate with respect to the housing 6 without hindrance and without the need to rotate the link 1 with respect to the housing 6. In this way, after the hoisting force has been removed, the link remains vertically oriented, so that the coupling element 2 is suspended from the link 1. Therefore, no moment, or scarcely any moment, is exerted on the anchor 4 by the weight of the hoisting assembly. The coupling element 2 can then easily be pushed off the free end of the anchor 4, with the resistance which has to be overcome being minimized.

In the above-described manner of hoisting the construction element 3 and moving it from the horizontal position into the vertical position, the construction element 3 rotates about an axis of rotation which is substantially parallel to that part of the U-shaped bracket 16 which forms the rotation axle for the housing 6 and the closure element 7. However, in practice it is sometimes the case that the construction element 3 has to rotate about an axis of rotation which is substantially parallel to the passage direction of the coupling opening 12.

Figure 3:
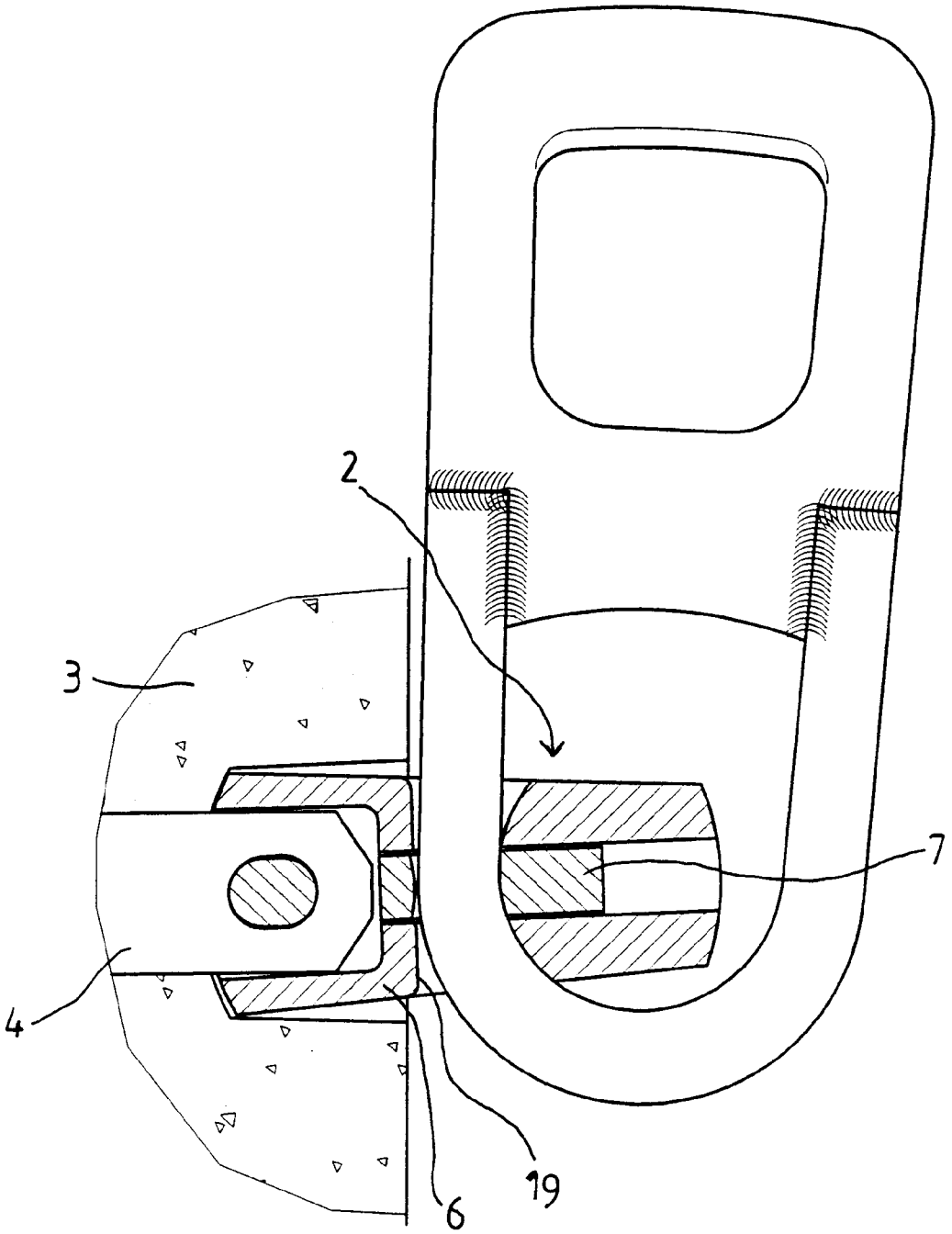
FIG. 3 shows a view, partially in section, of a hoisting assembly according to the invention, where the lifting force is parallel to the axis of the coupling element and the viewing plane is perpendicular to the viewing plane of FIG. 1.

FIG. 3 shows the situation where the free end of the anchor 4 is situated in a cavity at an edge of the construction element 3. In order to be able to move the construction element 3 from the horizontal position to a vertical position, it is at first necessary to exert on the coupling element 2 a hoisting force which is substantially perpendicular to the passage direction of the coupling opening 12 and perpendicular to the longitudinal direction of the anchor 4. It can be seen in FIG. 3 that the free end of the anchor 4 is enclosed in a close-fitting manner by the housing 6 of the coupling element 2. The anchor 4 which is accommodated in the anchor-accommodating space 13 in the housing 6 is enclosed between the axial front wall and the axial rear wall of the housing. Movement of the anchor 4 and the housing 6 with respect to one another in the axial direction is therefore impossible. If the anchor has been inserted into the anchor-accommodating space 13 to the maximum extent, rotational movements of the anchor 4 and the housing 6 with respect to one another are also limited. In particular, rotation of the housing 6 about an axis of rotation which is parallel to the passage direction of the coupling opening 12 is prevented. Owing to the fact that the housing 6 cannot rotate with respect to the anchor 4, the housing 6 will exert a moment on the anchor 4 owing to the hoisting force. This has the positive effect of preventing the housing 6 from coming to bear against the end face of the construction element 3. The construction element therefore will not be damaged by the housing 6 during hoisting. Additional protective measures, for example in the form of "wings" on the anchor 4, are therefore superfluous. During manufacture of the construction element 3, it is sufficient to attach a single type of anchor which is suitable for all hoisting situations, thus providing a major economic benefit.

The hook part 10 may have a round cross-section, but may also have an elliptical or other suitable cross-section. The free end of the hook part 10 is preferably at least partially tapering. As a result, the hook part 10 is self-aligning when the closure element 7 is rotated into the locking position when the anchor 4 is present in the anchor-accommodating space 13 in the housing 6.

A round cross-section is the most suitable form for the bracket 16, particularly for those sections of the bracket 16 which form a rotation axle for the housing 6 and the closure element 7.

One advantage of the hoisting assembly according to the invention is that the closure element 7 cannot readily be removed from the space inside the housing 6, owing to the fact that the link 1 is inserted through the insertion opening 19 and the hoisting eyelet 15.

The various aspects of the invention can also be employed independently of one another in a hoisting assembly.

The embodiment described above is given as a non-limiting example. It will be clear to a person skilled in the art that various alterations and modifications to the exemplary embodiments are possible without departing from the scope of the invention as defined in the appended claims.

For example, in order to save on material, it is possible to form the housing 6 in such a manner that only the force-absorbing parts form the housing. The housing 6 can be designed as two parallel plates with spacers, the plates defining the anchor-accommodating space 13 and the insertion opening 19 being arranged in the plates.

What is claimed is:

1. Hoisting assembly comprising a hoisting element and a coupling element for coupling the hoisting assembly to an anchor element which is attached to an object to be lifted, the coupling element comprising a housing, an anchor-accommodating space and an insertion opening, which extends through the housing, being arranged in the housing, the anchor-accommodating space being suitable for accommodating a free end of the anchor element, and the hoisting element extending through the insertion opening, the coupling element furthermore comprising a closure element which is arranged movably in the housing, which closure element can be moved between a locking position, in which the closure element extends through the anchor-accommodating space, so that an anchor element accommodated in the anchor-accommodating space can be held in place, and a release position, in which the closure element is withdrawn from the anchor-accommodating space, so that an anchor element accommodated in the anchor-accommodating space can be released, an actuating member, by means of which the closure element can be actuated so as to move between the locking position and the release position, furthermore being arranged on the closure element, the closure element comprising a hoisting eyelet and a hook part, the hoisting eyelet being coaxial with the said insertion opening in the housing and the hook part, in the locking position, extending through the anchor-accommodating space.

2. Hoisting assembly according to claim 1, in which a passage opening for the actuating member is arranged in the hoisting element, so that the closure element can move between the locking position and the release position irrespective of the position of the hoisting element.

3. Hoisting assembly according to claim 1, which the hook part is provided with a projecting edge.

4. Hoisting assembly comprising a hoisting element and a coupling element for coupling the hoisting assembly to an anchor element which is attached to an object to be lifted, the coupling element comprising a housing, an anchor-accommodating space and an insertion opening, which extends through the housing, being arranged in the housing, the anchor-accommodating space being suitable for accommodating a free end of the anchor element, and the hoisting element extending through the insertion opening, the coupling element furthermore comprising a closure element which is arranged movably in the housing, which closure element can be moved between a locking position, in which the closure element extends through the anchor-accommodating space, so that an anchor element accommodated in the anchor-accommodating space can be held in place, and a release position, in which the closure element is withdrawn from the anchor-accommodating space, so that an anchor element accommodated in the anchor-accommodating space can be released, an actuating member, by means of which the closure element can be actuated so as to move between the locking position and the release position, furthermore being arranged on the closure element, the anchor-accommodating space being delimited by wall sections which are integral with the housing. in such a manner that the anchor element can be accommodated in the anchor-accommodating space in a close-fitting manner, in which the closure element comprises a hoisting eyelet and a hook part, the hoisting eyelet being coaxial with the said insertion opening in the housing and the hook part, in the locking position, extending through the anchor-accommodating space.

5. Hoisting assembly according to claim 4, in which a passage opening for the actuating member is arranged in the hoisting element, so that the closure element can move between the locking position and the release position irrespective of the position of the hoisting element.

* * * * *

UNITED STATES PATENT AND TRADEMARK OFFICE

CERTIFICATE OF CORRECTION

PATENT NO. : 6,142,546
DATED : November 7, 2000
INVENTOR(S) : Marinus G.A. Hansort It is certified that error appears in the above-identified patent and that said Letters Patent is hereby corrected as shown below:

Column 7,
Line 10, before "which" insert --in--.

Column 8,
Line 10, after "housing" change the period to a comma.

Signed and Sealed this

Twenty-sixth Day of June, 2001

*Attest:*

Nicholas P. Godici

NICHOLAS P. GODICI
*Acting Director of the United States Patent and Trademark Office*

*Attesting Officer*